US006319009B1

(12) United States Patent
Radgens

(10) Patent No.: US 6,319,009 B1
(45) Date of Patent: Nov. 20, 2001

(54) KIT FOR GLASS ART

(76) Inventor: Thomas H. Radgens, 7340 Bingham, Dearborn, MI (US) 48126

( * ) Notice: Subject to any disclaimer, the term of this patent is extended or adjusted under 35 U.S.C. 154(b) by 0 days.

(21) Appl. No.: 09/545,122

(22) Filed: Apr. 7, 2000

(51) Int. Cl.[7] ..... B44C 5/08

(52) U.S. Cl. ..... 434/81; 65/36; 65/43; 428/38

(58) Field of Search ..... 434/82, 81; 65/36, 65/43, DIG. 5; 428/38

(56) References Cited

U.S. PATENT DOCUMENTS 274,948 * 4/1883 LaFarge .
3,064,380 * 11/1962 Baut et al. .
3,680,225 * 8/1972 Ishida ..... 35/26
3,800,441 * 4/1974 Macpherson ..... 35/26
3,815,263 * 6/1974 Oberwager ..... 35/26
4,233,863 * 11/1980 Cooper et al. .
4,252,847 * 2/1981 DelGrande ..... 428/38
4,342,611 * 8/1982 Tuttle ..... 156/63
5,364,470 * 11/1994 Greensberg ..... 118/500
5,501,888 * 3/1996 Hanson et al. ..... 428/38
5,989,666 * 11/1999 Hadden ..... 428/38

* cited by examiner

*Primary Examiner*—John A. Ricci

(57) ABSTRACT

A kit for glass art in which a blank is cut from covered sheet plastic to a shape that encompasses a picture including artistic designs drawn on the covering. The artistic designs are cut out to create artistic openings through the surface of the plastic blank, each opening defined by edges having a thickness. An indentation is machined along the center of the thickness of the entire edge of each opening. Stained sheet glass is cut and ground by conventional methods to pieces which fit within matching openings in the plastic blank. The edges of the openings and stained glass pieces are foiled with foil tape and the glass pieces are soldered within their matching openings in the plastic blank with heat and melted solder. The covering of the plastic blank is removed to reveal the picture made of stained glass designs within the plastic blank of the kit.

2 Claims, 1 Drawing Sheet

2
10
12

10
14
16

4
26
28

28

18
22
24
20

KIT FOR GLASS ART

BACKGROUND OF THE INVENTION

This invention relates to glass art generally as a method to construct an artwork by preparing and soldering stained sheet glass pieces together and more particularly to a kit for glass art which is completed by soldering pre-cut stained sheet glass pieces into matching artistic openings to produce a stained glass effect artwork in prefabricated impact resistant sheet plastic.

Glass art produced with only stained sheet glass always has solder lines from the subject to the edges of the picture which in many instances makes the artwork appear unnatural; a problem which is readily resolved by using sheet plastic.

Plastic is not chosen for use in constructing glass art because the heat of soldering glass to plastic often distorts the plastic causing spider webs to form in the plastic at the solder joints.

SUMMARY OF THE INVENTION

I have invented a kit which broadens the scope of glass art by using impact resistant sheet plastic in combination with pre-cut stained sheet glass pieces to construct an artwork with no solder lines from the subject to the edges of the picture. The kit is designed to be easily completed by a person with ordinary skill in foiling glass and ordinary skill in soldering using heat and melted solder.

A user of the kit foils the edges of openings in a plastic blank and foils said stained glass pieces and solders said stained glass pieces within said openings to create a natural looking picture. The result may be a fish that looks like it is swimming in water or a bird that looks like it is gliding through the air or an orb spider in its web with no obstructions or lines of solder. The plastic Kit adds strength to the artwork while retaining the beauty of all glass construction; it is weather resistant and may be displayed out-doors or in-doors and is washable in detergents or soapy water.

DETAILED DESCRIPTION OF THE INVENTION

Figures 1, 2, 3, 4, 5, 6:
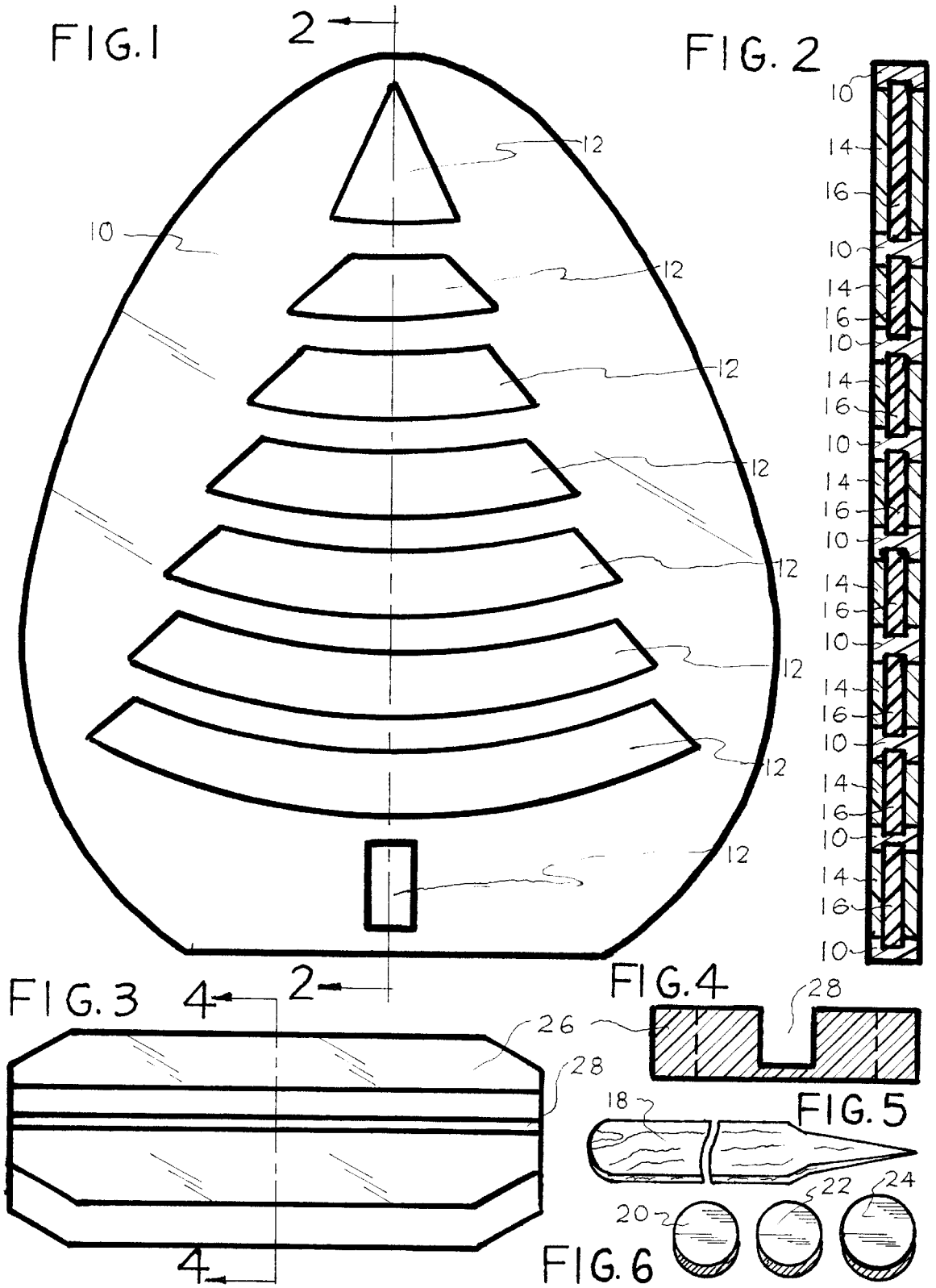
FIG. 1 is a front elevation view of the plastic blank 10 containing the cut-out openings 12.
FIG. 2 is a section view along plane 2—2 in which numeral 14 designates the edges of the openings which contain the indentation 16.
FIG. 3 is a perspective view of the base 26 having a longitudinal groove 28.
FIG. 4 is a section view taken along plane 4—4 of the base 26 and the groove 28.
FIG. 5 is a partial view of the foiling tool 18.
FIG. 6 is a perspective view of the spacers 20, 22, and 24.

Impact resistant sheet plastic comes with a protective covering on both surfaces to prevent scratches during transport and use. The plastic blank in the kit for glass art is made of said impact resistant sheet plastic of the generic name polycarbonate, with protective covering intact, which is cut to a shape that encompasses a picture made up of one or more artistic design(s) outlined on said covering of said plastic. The outlined designs are cut out causing artistic opening(s) through the surface of said plastic blank; each artistic opening defined by edges having a thickness. The entire edge of each artistic opening through the blank is machined with a tiny indentation centered along the thickness of each edge to prevent said pre-cut stained glass piece(s) soldered within said opening(s) from being dislodged. The use of said plastic in the kit is not limited to clear, transparent plastic; translucent or opaque plastics work equally well to produce an artwork using the kit.

The kit is designed to eliminate the problem of distortion and spider webs which form in impact resistant sheet plastic at the solder joints during soldering of glass to plastic. This is accomplished by foiling only the very edge of each opening in the plastic with foil tape so that the heat of soldering is dispersed from the center of the foil to the surfaces of the plastic and the surfaces of the glass where said heat is dissipated to the surrounding air.

Foil tape which is heated during soldering of glass to plastic does not bond to the plastic, therefore foiling only the very edge of each opening provides no mechanism to retain soldered glass pieces within the openings. The mechanism is provided by changing the shape of the edges of tho openings so that foil tape which conforms to the new shape stiffens and remains firmly in place. The change in the shape of said edges may be in the form of an indentation along the center of the thickness of the entire edge of each opening; an elevated bead along the center of the thickness of the entire edge Of each Opening; a roughening of the entire edge of each opening or a concave shaped edge or a V shaped edge of each opening. I use the indentation mechanism by machining a tiny indentation along the center of the thickness of the entire edge of each opening.

Referring to the drawings, in FIG. 1 the numeral 10 represents the plastic blank 10 of the kit, made of sheet plastic, which is approximately 7 inches wide, 8 inches high and ¼ inch thick which I made by creating a picture of artistic designs, drawing the artistic designs on the covering of said sheet plastic, outlining the shape of the blank 10 of the kit to encompass said artistic designs and cutting the blank 10 to the shape outlined on said covering of the plastic. Artistic openings 12 through the surface of the plastic blank 10 are made by cutting out said artistic designs drawn on said covering of the plastic blank 10; said artistic openings defined by edges having a thickness. Stained sheet glass, approximately ⅛ inch thick, is cut and ground by conventional methods to pieces with smooth perpendicular edges which fit within matching openings in the plastic blank 10. The stained sheet glass pieces and matching openings 12 are numbered, when required, to prevent confusion in the more intricate artworks. In FIG. 2 an indentation 16 approximately 1/16 inch wide and approximately 1/16 inch deep is machined along the center of the thickness of the entire edge 14 of each opening 12 to prevent said stained sheet glass pieces from moving or being dislodged after said pieces are soldered within the openings 12 in the plastic blank 10 of the kit. A concave shaped edge 14 or a V shaped edge 14 functions equally well to retain stained sheet glass pieces soldered within the openings 12 of the plastic blank 10.

A user of the kit, having ordinary skill in fouling glass and ordinary skill soldering with heat and melted solder, foils each stained glass piece, by conventional methods, with foil tape and foils the edges 14 and the indentations 16 of the openings 12 in the plastic blank 10 of the kit with foil tape and may use a piece of wood 18, FIG. 5, which is rounded on one end to smooth the foil and pointed on the other end to push foil into the indentations 16. A thin film of flux is applied to the foil of each stained glass piece and to the foil of the edges 14 of the openings 12 in the plastic blank 10 of the kit. A glass piece is centered within its matching opening

12 using spacers 20, 22, and 24, FIG. 6, and soldered into place with heat and melted solder. After all of the remaining glass pieces are similarly soldered within matching openings 12, the soldered glass pieces are cleaned and polished on both sides and said protective covering of the plastic blank 10 is removed to reveal the completed picture in the plastic blank 10 of the kit which may be displayed by a base 26, FIG. 3 and FIG. 4, when it is inserted into the groove 28 which transverses the longitudinal surface of the base 26.

Based upon the foregoing discussion I am of the opinion that my invention has fulfilled a long-felt need in the field of glass art and that I have made a valuable contribution to the related art; however while the invention is described with reference to the structural details of a single embodiment, the principles involved are susceptible of numerous other practical adaptations.

Therefore I claim:

1. A method of producing a stained glass effect artwork, comprising the steps of:

providing a sheet of plastic having a protective covering thereon;

outlining the shape of the desired artwork onto the protective covering, and cutting out the shape from the sheet to form a blank;

outlining a plurality of artistic designs onto the protective covering of the blank, and cutting out the artistic designs from the blank, forming artistic openings through the blank, each artistic opening defined by edges having a thickness;

machining an indentation along the entire edge of each artistic opening, the indentation centered along the thickness of each edge;

outlining the shape of each artistic opening through the blank onto the surface of stained sheet glass;

cutting out the outlined glass shapes from the sheet glass to obtain stained glass pieces with smooth perpendicular edges;

foiling the indented edge of each artistic opening with foil tape; and foiling the edges of each stained glass piece with foil tape;

applying flux to the foil of each artistic opening and each stained glass piece;

centering each stained glass piece within its associated artistic opening;

applying melted solder to the foil of each artistic opening and associated stained glass piece and allowing the solder to harden, to retain the stained glass pieces within the artistic openings; and removing the protective covering of the plastic blank to reveal the stained glass effect artwork.

2. A kit for producing a stained glass effect artwork, comprising; a sheet plastic blank in the shape of an artwork and having a protective covering thereon;

a plurality of artistic designs cut out of the plastic blank, forming artistic openings defined by edges having a thickness;

an indentation along the entire edge of each artistic opening, the indentation centered along the thickness of each edge;

a plurality of stained glass pieces defined by edges, each corresponding in shape for receipt in an associated artistic opening;

foil tape for placement along the indented edge of each artistic opening, and for placement around the edges of each stained glass piece;

a tool to facilitate placement of the foil into the indented edges, and to smooth the foil;

flux for application to the foil;

solder for melting and application to the foil;

whereby a user places and centers each stained glass piece within its associated artistic opening, and applies melted solder to the foil of the stained glass piece and artistic opening, and allows the solder to harden, to retain the stained glass pieces within the artistic openings, and removes the protective covering of the plastic blank to reveal the stained glass effect artwork.

* * * * *